US008100603B2

(12) United States Patent
Sampson

(10) Patent No.: US 8,100,603 B2
(45) Date of Patent: Jan. 24, 2012

(54) ROLLER DRUM ASSEMBLY FOR PACKING A SURFACE

(76) Inventor: Russel H. Sampson, Fall River, MA (US)

( * ) Notice: Subject to any disclaimer, the term of this patent is extended or adjusted under 35 U.S.C. 154(b) by 0 days.

(21) Appl. No.: 12/456,997

(22) Filed: Jun. 25, 2009

(65) Prior Publication Data

US 2010/0008725 A1 Jan. 14, 2010

Related U.S. Application Data

(60) Provisional application No. 61/133,160, filed on Jun. 26, 2008.

(51) Int. Cl.
*E01C 19/24* (2006.01)

(52) U.S. Cl. ..... 404/131

(58) Field of Classification Search ..... 404/122, 404/129, 131; 15/97.3; 239/164, DIG. 6, 239/526, 532, 373
See application file for complete search history.

(56) References Cited

U.S. PATENT DOCUMENTS 572,447 A * 12/1896 Puffer ..... 404/129
588,445 A * 8/1897 King ..... 404/129
924,506 A * 6/1909 Stouffer ..... 404/129
2,101,150 A * 12/1937 Moore, Jr. ..... 404/85
2,990,755 A * 7/1961 Caufield ..... 404/95
3,120,159 A * 2/1964 White ..... 404/95
3,152,353 A * 10/1964 Cravener ..... 401/219
3,215,316 A * 11/1965 Klempay ..... 222/167
3,453,058 A * 7/1969 Bixel ..... 401/188 R
RE26,675 E * 9/1969 Ferm et al. ..... 404/76
3,477,535 A * 11/1969 Wyatt ..... 180/20
4,356,584 A 11/1982 Zamboni
4,624,602 A * 11/1986 Kieffer et al. ..... 404/94
4,695,186 A 9/1987 King
4,821,959 A * 4/1989 Browing ..... 239/121
5,022,783 A * 6/1991 Jones ..... 404/122
5,222,828 A * 6/1993 Magalski ..... 404/103
5,333,795 A * 8/1994 Jessen ..... 239/663
5,480,259 A * 1/1996 Thrower ..... 404/117
5,533,676 A * 7/1996 Conley ..... 239/663
D383,141 S * 9/1997 Martini ..... D15/13
5,860,764 A 1/1999 Roberts
5,906,445 A * 5/1999 Johnson ..... 401/48
6,123,478 A * 9/2000 Giles ..... 401/219
6,302,620 B1 * 10/2001 Mutsuji et al. ..... 404/131
6,827,524 B2 * 12/2004 Starry et al. ..... 404/129
6,935,579 B1 * 8/2005 Lindsey ..... 239/530
7,043,890 B2 * 5/2006 Lofton ..... 56/16.8
7,111,631 B1 9/2006 Breeze
7,140,804 B2 * 11/2006 Gregg ..... 404/93
7,213,997 B1 * 5/2007 Joyner ..... 401/197
7,347,645 B2 * 3/2008 Gregg ..... 404/93
2004/0084552 A1 * 5/2004 Huartson ..... 239/146
2006/0254008 A1 * 11/2006 Hahn et al. ..... 15/50.3

* cited by examiner

*Primary Examiner* — Robert Pezzuto
*Assistant Examiner* — Matthew D Troutman
(74) *Attorney, Agent, or Firm* — Pandiscio & Pandiscio

(57) ABSTRACT

A roller drum assembly includes a roller drum for rotationally engaging a surface, a frame connected to the roller drum for manually controlling movement of the assembly, a tank mounted on the frame for retaining a liquid, and conduits mounted on the frame for directing the liquid from the tank to the roller drum, and further includes a wand mounted on the frame and in communication with the tank, for ejecting the liquid onto selected surfaces spaced from the roller drum assembly.

12 Claims, 6 Drawing Sheets

ROLLER DRUM ASSEMBLY FOR PACKING A SURFACE

CROSS-REFERENCE TO RELATED APPLICATION

This application claims priority from U.S. Provisional Patent Application No. 61/133,160, filed Jun. 26, 2008, in the name of Russel H. Sampson.

BACKGROUND OF THE INVENTION

1. Field of the Invention

This invention is directed to a hand operated roller drum assembly of the type typically used for rolling asphalt or concrete or stone dust passageways, parking lots, and the like.

2. Description of the Prior Art

It is known to pack and smooth passageway surfaces of granular material, such as asphalt, concrete, stone dust and the like, to provide a packed, smooth and/or level surface. The tool usually used for such endeavors comprises a roller drum rotatably attached at each end thereof to a frame member which usually includes a handle portion by which the assembly may be grasped and maneuvered by an operator.

In the course of using rollers of the prior art, clumps of material being packed and leveled tend to cling to the surface of the roller and can gouge holes or depressions in an otherwise smooth passageway surface. Accordingly, it is necessary to periodically stop and wash off the surface of the roller, or have a second roller worker apply water and/or oil to the surface of the roller to carry away accumulated material.

It is customary for either the roller operator, or a second worker, to carry a jug, typically of diesel oil, and periodically pour the oil onto the roller to cleanse the roller.

A further problem which operates against expeditious rolling of a surface is that of delivering the matter of the surface, i.e. asphalt, and the like, to the site of the surface being rolled. The surface material typically is delivered to the site by a truck equipped with shuttle chutes which channel the surfacing material from the truck into a wheelbarrow, or other receptacle, which is used to transport the material to the area to be rolled. Surfacing material tends to stick to the surfaces of the chutes and the wheelbarrows and/or receptacles. Usually, a worker must physically urge the material down the chute.

A still further problem usually encountered in such operations is the periodic need to apply liquid to a particular limited area of the passageway surface, or other surface, beyond that which is applied by the roller.

There is thus a need for a roller assembly having facility for packing and smoothing paving material, and further for applying water or oil and/or other liquid to the roller for discouraging accumulation thereon of the paving material and for washing away any material on the roller well prior to accumulation of substantial lumps of the material.

There is further a need for having at hand, in the vicinity of the roller assembly, means for expediting the delivery of the surfacing material from a truck delivering such material to the point of use.

There is still further a need for having at hand, in the vicinity of the roller assembly, means for "spot" application of the liquid.

SUMMARY OF THE INVENTION

An object of the invention is, therefore, to provide a roller drum assembly for packing, smoothing and leveling passageway surface material and having facility for washing the surface of the roller during the roller operation, without the need of an independent wetting and washing means or person. That is, one object of the invention is to provide means on the roller assembly for applying a selected liquid medium to the roller while the roller assembly is in operation to continuously wash the surface of the roller.

A further object of the invention is to provide means on the roller assembly for applying the selected liquid medium to conveyer surfaces which are contacted by the surface material while in transit from a delivery vehicle to the roller assembly, the means being operable by the roller assembly operator.

A still further object of the invention is to provide means on the roller assembly for spot application of the liquid medium to specific areas requiring the liquid medium.

With the above and other objects in view, a feature of the present invention is the provision of a roller drum assembly, the assembly including a roller drum for rotatably engaging a surface to be packed and/or leveled, and a frame connected to the roller drum for manually controlling movement of the roller drum assembly. A tank is mounted on the frame and is adapted to contain a liquid therein. Conduits are mounted on the frame and are adapted to convey the liquid from the tank to the surface of the roller drum to cleanse the surface of the roller drum while the roller drum is in operation.

A further feature of the present invention is the provision of a roller drum assembly including a roller drum for rotatably engaging a surface material to be packed and/or leveled, and a frame connected to the roller drum for manually controlling movement of the roller drum on the surface. A tank is mounted on the frame and is adapted to contain a liquid therein. A wand is mounted on the frame and is in communication with the tank by way of a flexible hose extending therebetween. The wand is removable from the frame and is moveable to a location spaced from the frame by a distance generally equal to the length of the hose. The wand is provided with a trigger mechanism, the operation of which enables liquid in the tank to be ejected from the hose and onto a coveyer surface adapted to be in contact with the surface material prior to the rolling thereof by the roller drum.

A still further feature of the invention is the provision of the aforesaid wand adapted for spot application of the liquid onto selected specific areas.

A still further feature of the invention is in the provision of a roller drum assembly having the above two features therein, i.e., means on the roller assembly for applying a liquid to the roller drum surface for cleansing the surface of the roller drum, and means on the roller assembly for directing the liquid onto other surfaces adapted to come in contact with the surface material prior to the rolling of the surface material and onto specific selected areas proximate the assembly.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent.

In the drawings.

DESCRIPTION OF THE PREFERRED EMBODIMENTS

Figure 1:
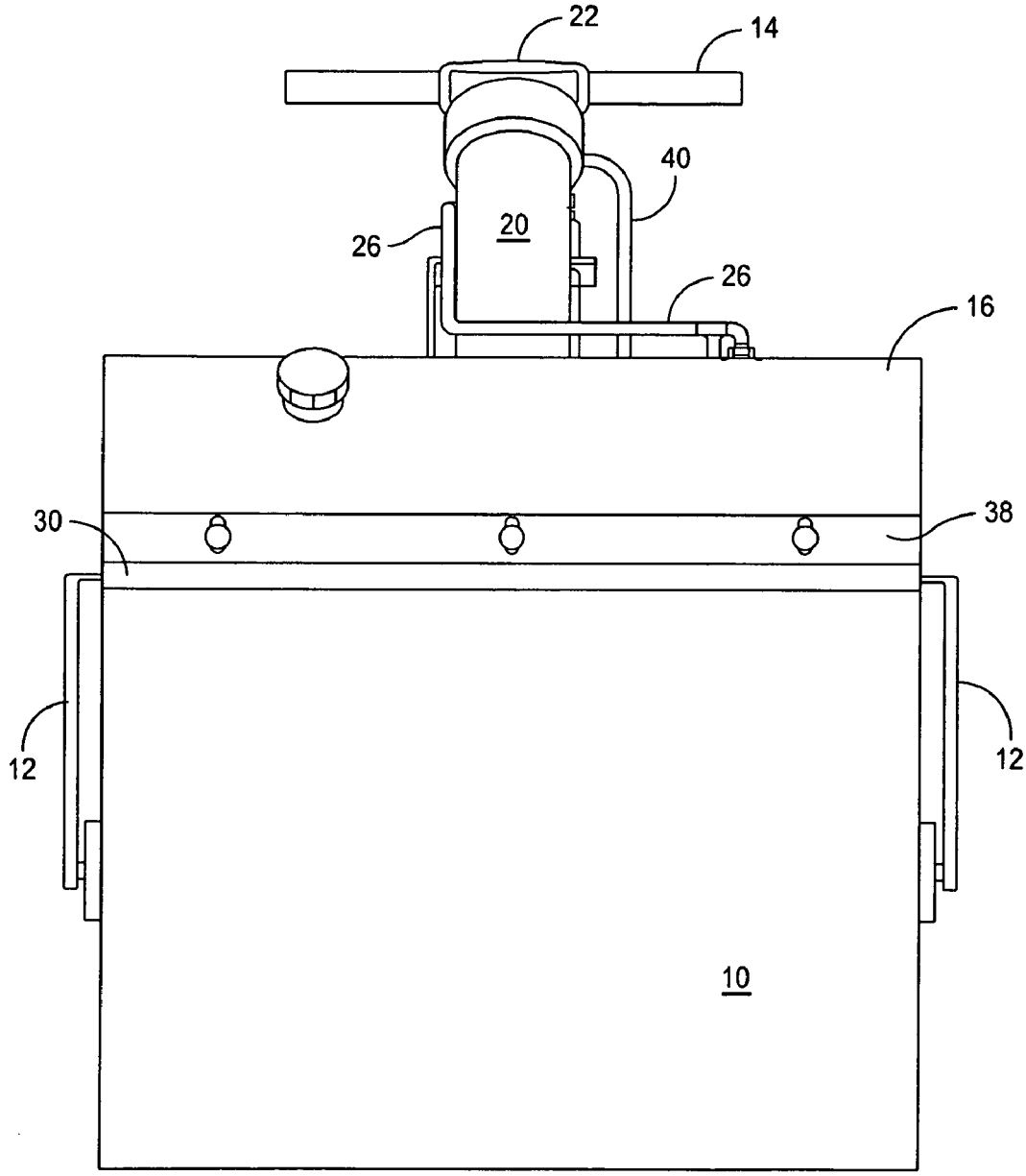
FIG. 1 is a front elevational view of one form of roller drum assembly illustrative of an embodiment of the invention.
Figure 2:
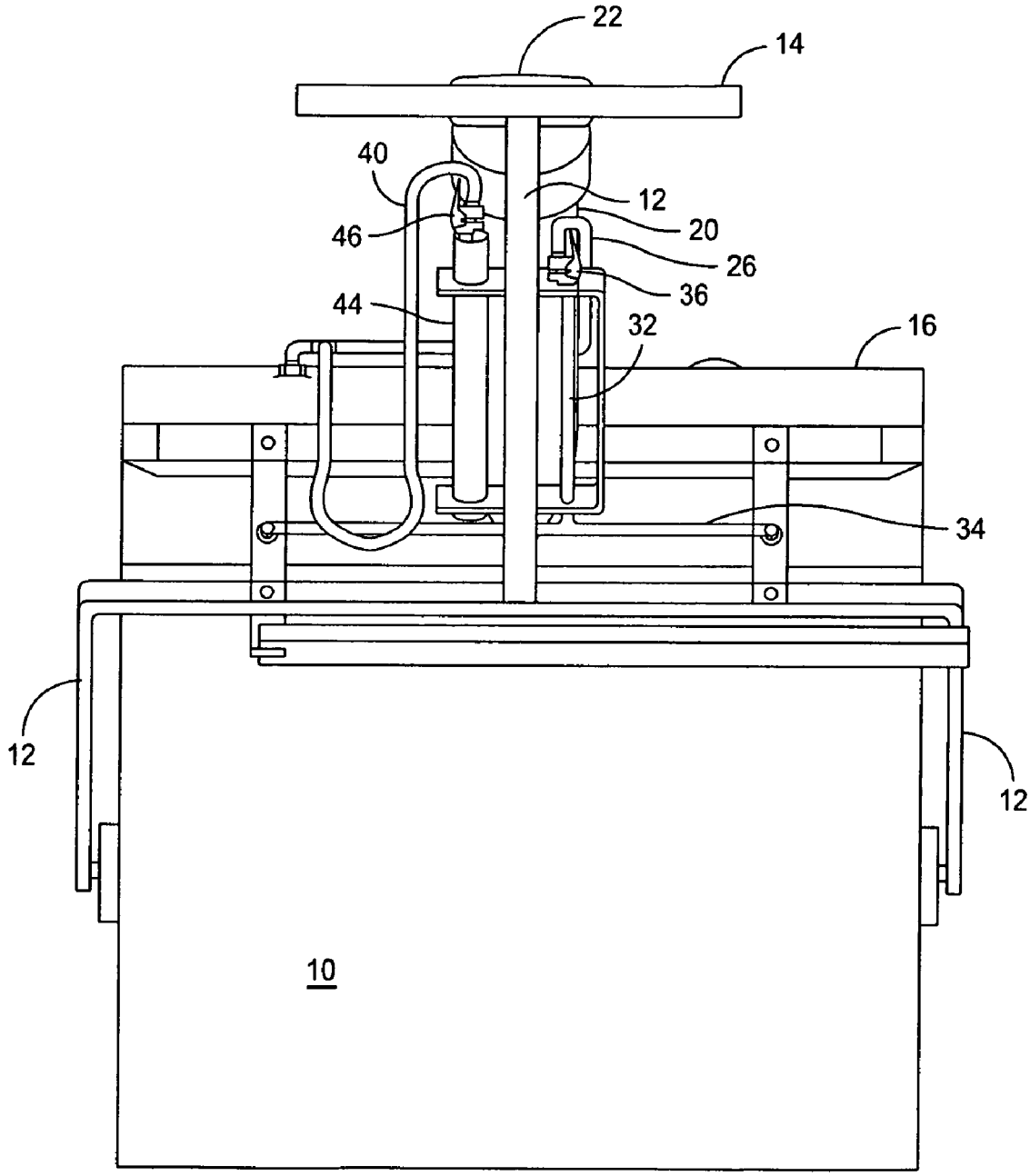
FIG. 2 is a rear elevational view thereof.

Referring to the drawings, it will be seen that an illustrative roller drum assembly includes a roller drum 10 for engaging a surface to be packed and/or leveled, or smoothed. Passageways, such as streets, driveways, pedestrian walks, parking lots, runways, ramps, speed bumps, and the like, are the most common passageway surfaces requiring some packing or compacting, as well as leveling and/or smoothing.

A frame 12 is connected to the roller drum 10 such that the roller drum can rotate. The frame 12 includes a handle portion 14 adapted to be gripped by an operator and used to manually control movements of the roller drum. The frame 12 may be configured as shown in the drawings, with the handle of a "T" shaped configuration, or may be a "U" shaped member, well known in combination with pusher-type wheel devices.

A tank 16 is mounted on the frame 12 and is adapted to contain a selected liquid, usually water or oil, such as diesel oil.

Mounted on the frame 12 is a pump 18 (FIGS. 4 and 6) disposed within a housing 20 joined to the tank 16. The pump 18 is provided with a grip member 22 for manually operating the pump. The interior of the housing 20 is in communication with the interior of the tank 16 by way of a one-way valve 23, such that the pump 18 is adapted to pressurize the tank 16, causing liquid in the tank to move into an inlet tube 24 (FIGS. 3 and 6) disposed in the tank and in communication with a drum sprayer feed tube 26.

The drum sprayer feed tube 26 connects with a spray pipe 34 which extends widthwise substantially throughout the length of the roller drum 10 and is provided with a plurality of spray nozzles 28 thereon. As shown in FIGS. 3-6, the spray nozzles 28 are adapted to project a spray of liquid onto the surface of the drum 10 and also onto a sponge-like strip 30 which is fixed to the bottom of the tank 16 by a bracket 38 and engages the surface of the roller drum 10.

The strip 30 serves to spread the liquid sprayed thereon over the surface of the drum 10 and to wipe the surface of the drum free of any adhered debris.

Figure 3:
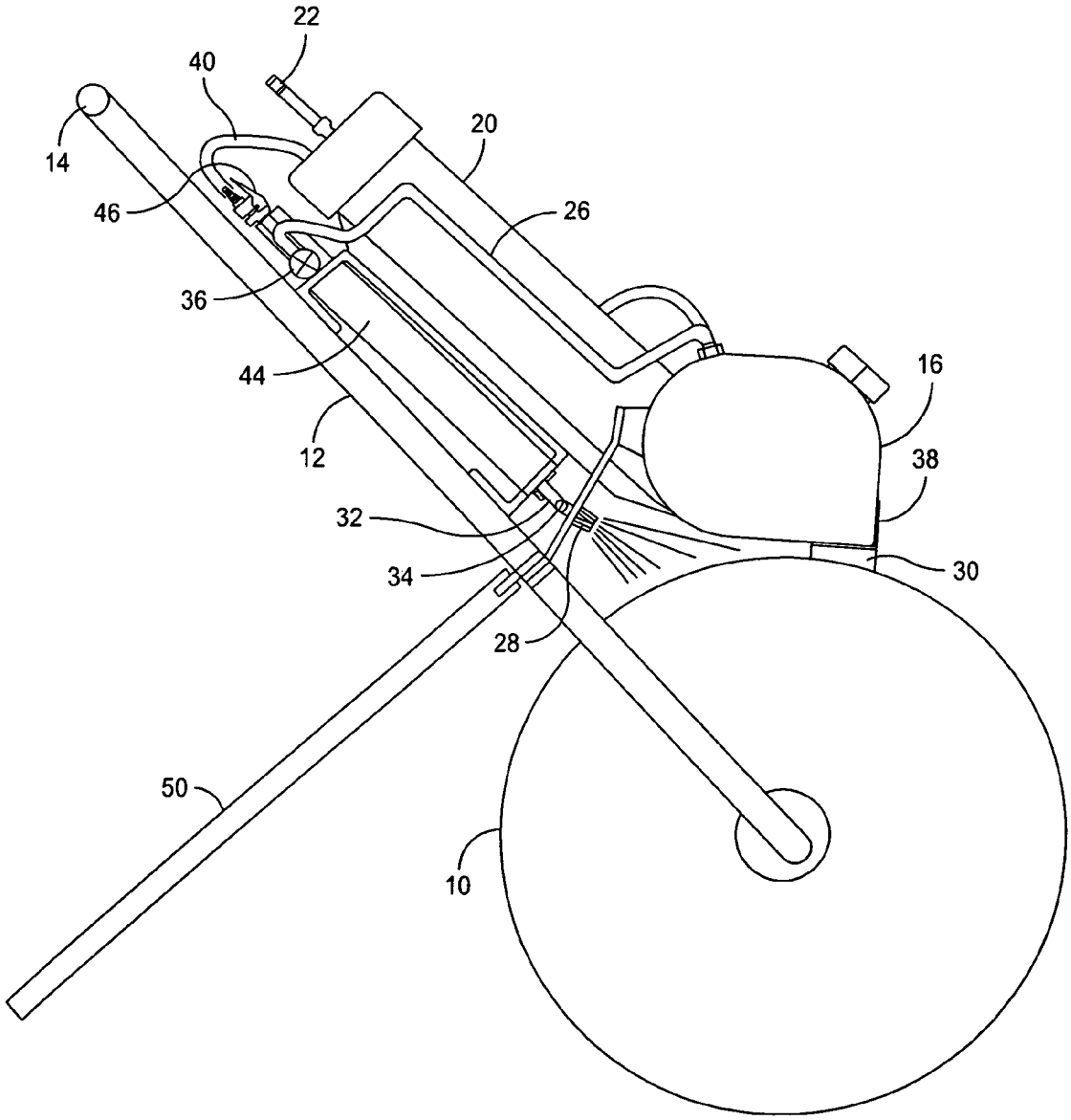
FIG. 3 is a right side elevational view thereof, showing a wand component housed in the assembly.

In operation of the assembly, an operator uses the handle 14 to move the roller drum 10 along a surface being treated. The operator periodically pumps the grip member 22 to pressurize the tank 16, causing liquid in the tank to enter the inlet tube 24 and progress through the drum sprayer feed tube 26 to engage a valve 36. The operator opens the valve 36 and the liquid proceeds through a spray tube 32 mounted on the frame 12, and to a spray pipe 34 which extends lengthwise of the roller drum and thence to the spray nozzles 28 which spray the liquid onto the drum surface and onto the sponge-like strip 30 for cleansing of the drum surface (FIG. 3).

Figure 4:
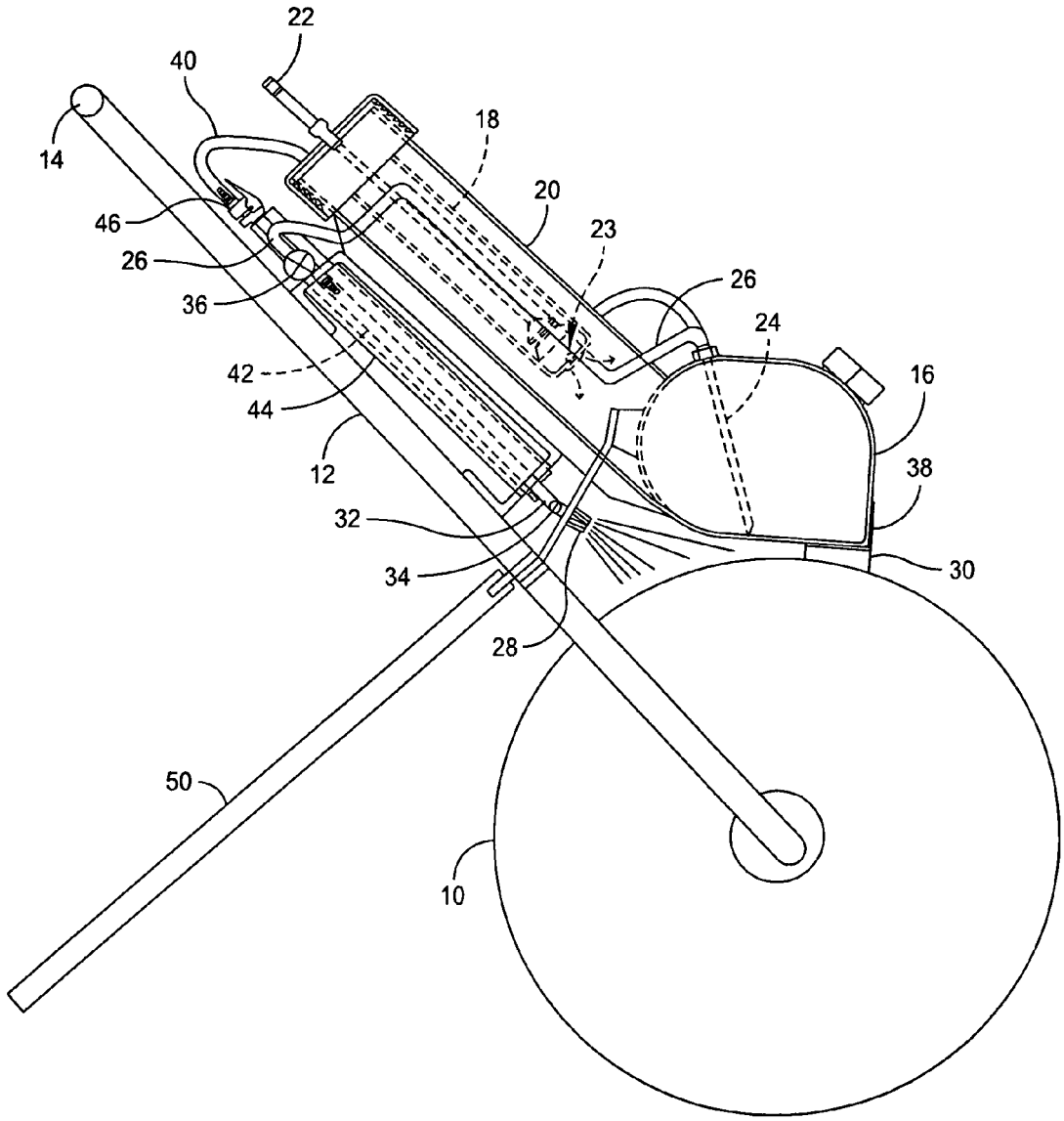
FIG. 4 is a further right side elevational view thereof with portions cut away to show internal components.
Figure 5:
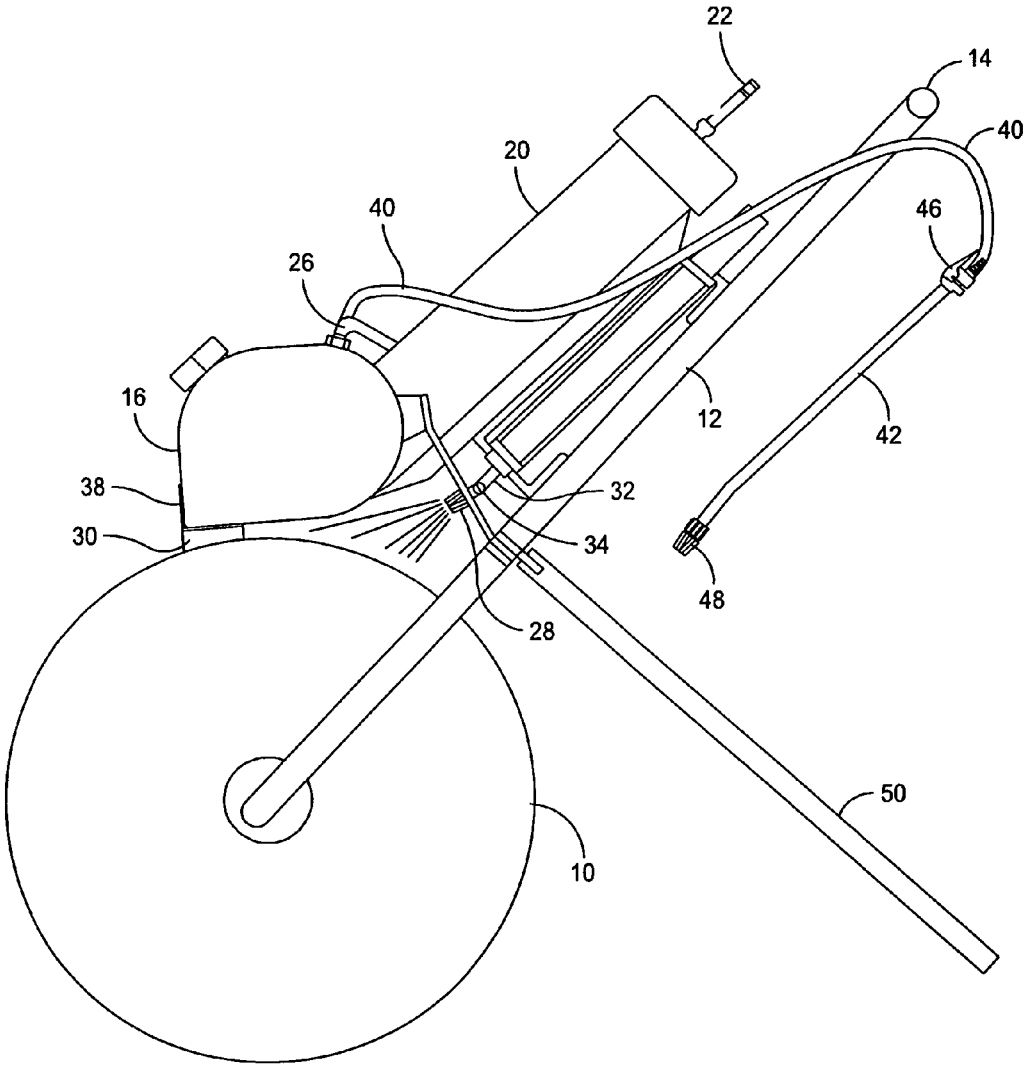
FIG. 5 is a left side elevational view thereof, showing the wand component of the assembly removed from the housing therefor.
Figure 6:
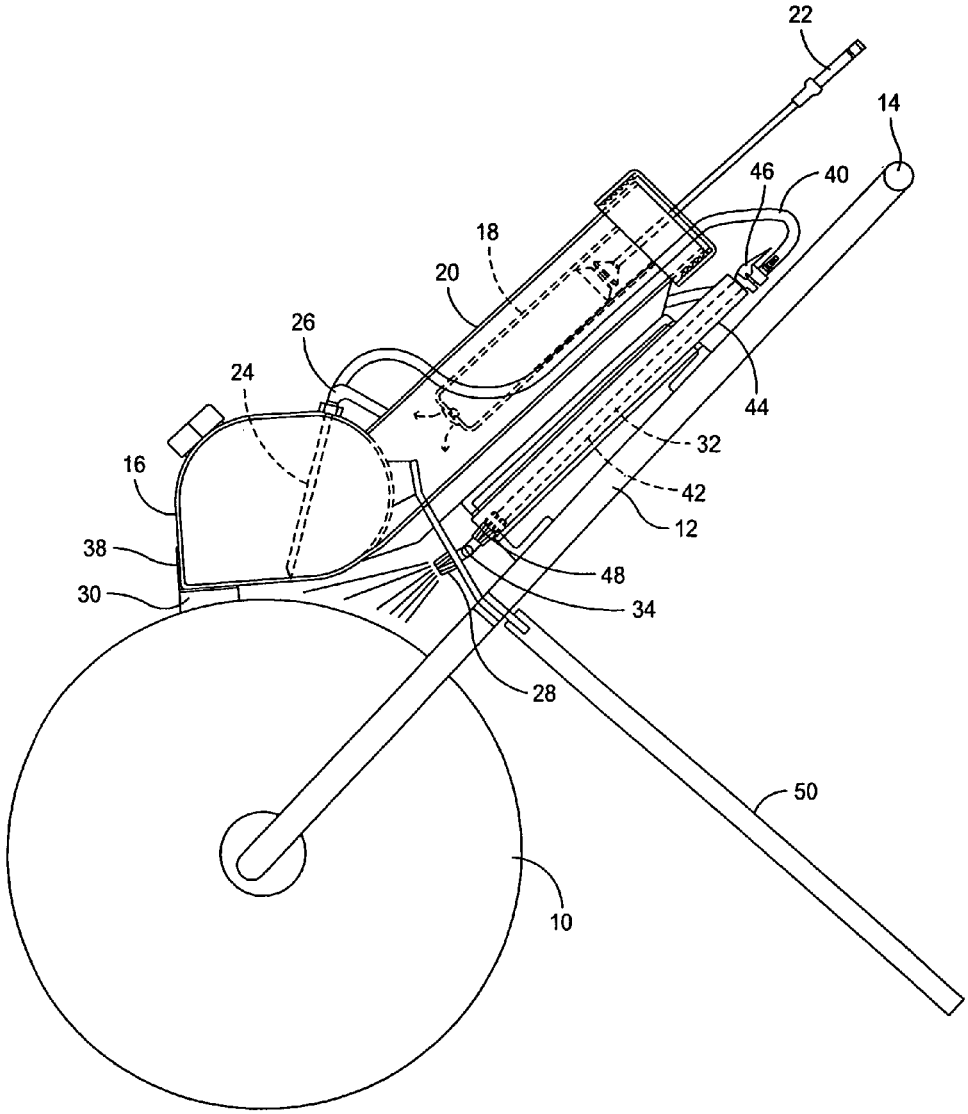
FIG. 6 is a further left side elevational view thereof with portions cut away to show internal components.

The tank inlet tube 24 is in further communication with a wand hose 40 connected to a wand 42 disposed in a wand housing 44 (FIGS. 4 and 6).

In the event that a spot application of liquid is required, the operator withdraws the wand 42 from the wand housing 44 and opens a wand valve 46 which may be a trigger-type or push button valve, to provide for flow of the liquid through the wand 42, to a spray nozzle 48 (FIG. 6) fixed to a distal end of the wand 42 and operable to spray the liquid onto a limited area under the direction of the operator.

As noted above, the limited area of concern is often the chutes through which paving material flows from a delivery truck. Other areas of concern are the flat footwear (tamper shoes) worn by personnel working on passageways, and the like, and wheelbarrows, and the like, in which the material is transported from the truck to the paving area.

Pivotally fixed to the frame 12 is a kick stand 50 which, in operative position as shown in FIGS. 3-6, serves to support the roller assembly in an upright disposition.

While the roller drum assembly has been described in relation to packing or leveling a passageway, parking lot, or the like, wherein the surface material is likely to be asphalt, concrete, stone dust, or gravel, it will be apparent that the roller drum assembly described herein finds utility in other areas of concern, such as lawn care, particularly large areas, as in parks and athletic fields, in which case the tank is typically filled with pesticide or fertilizer and the roller imparts a film of such liquids onto the grass, while the wand can be used for more concentrated applications, as well as for elevated plants and/or potted plants.

There is thus provided a roller drum assembly which provides savings in cost, time and personnel in packing and/or leveling passageways, and is further useful in other pursuits, such as lawn and plant care.

It will be understood that many additional changes in the details, materials, steps and arrangement of parts, which have been herein described and illustrated in order to explain the nature of the invention, may be made by those skilled in the art within the principles and scope of the invention as expressed in the appended claims.

What is claimed is:

1. A roller drum assembly comprising:

a roller drum for rotatably engaging a surface to be packed or leveled;

a frame connected to the ends said roller drum for manually controlling movement of the roller drum assembly, said frame having a U-shaped portion and a central handle portion extending from the U-shaped portion and adapted to be gripped by an operator and used to manually direct and control movements of said roller drum;

a tank and pump assembly mounted on said frame, said tank being adapted to retain a selected liquid;

conduits mounted on said frame for directing liquid from said tank to surface portions of said roller drum to cleanse the surface of said roller drum while said roller drum is in operation; and a wand housing mounted on said frame, and a wand adapted for disposal in said wand housing for dispensing the liquid onto said roller drum, and adapted for removal from said wand housing, for application of the liquid manually to a selected site removed from said frame, said wand being in communication with said tank by way of a flexible hose extending between said tank and said wand;

said wand being thus removable from said frame and moveable to a location spaced from said frame by a distance up to generally equal to the length of the hose; and a valve mechanism disposed on said wand and operable to enable the liquid in said tank to be ejected from the hose and onto the selected site spaced from the roller drum assembly.

2. The roller drum assembly in accordance with claim 1 wherein said conduits include a spray pipe extending along the length of said roller drum and spaced from and parallel to said roller drum, wherein the spray pipe is in communication with said tank and is provided with a plurality of spray nozzles for directing the liquid from said tank toward said roller drum.

3. The roller drum assembly in accordance with claim 2 wherein the roller drum assembly further comprises a strip of sponge material fixed to said tank and disposed proximate said spray pipe and engaging said roller drum, said strip being positioned to receive the liquid from said spray pipe and to apply the liquid received from the spray pipe to the roller drum by contact of said strip with said roller drum.

4. The roller drum assembly in accordance with claim 1 wherein said tank and pump assembly includes a pump for pressurizing said tank.

5. The roller drum assembly in accordance with claim 2 wherein the spray pipe spray nozzles are disposed along the length of the spray pipe.

6. The roller drum assembly in accordance with claim 3 wherein the spray nozzles are disposed so as to discharge the liquid onto said roller drum and the sponge strip, the sponge strip being disposed so as to engage and clean said roller drum.

7. The roller drum assembly in accordance with claim 4 wherein said pump comprises a manually operated pump.

8. The roller drum assembly in accordance with claim 4 wherein said tank is provided with an automatic pressure relief valve.

9. The roller drum assembly in accordance with claim 5 wherein said spray pipe is in communication with a spray housing, and an on-off valve is disposed on the spray housing.

10. The roller drum assembly in accordance with claim 2 wherein said spray nozzles each project a fan pattern of the liquid onto said roller drum.

11. The roller drum assembly in accordance with claim 1 wherein said wand is provided with a spray nozzle.

12. The roller drum assembly in accordance with claim 1 and further comprising a kick stand connected to said frame and adapted, in operative position, to support the roller drum assembly in an upright manner.

* * * * *